US006237643B1

(12) United States Patent
Wilson

(10) Patent No.: US 6,237,643 B1
(45) Date of Patent: May 29, 2001

(54) MULTI-AXIAL YARN STRUCTURE FORMING MACHINE

(75) Inventor: Robert Samuel Wilson, Belfast (GB)

(73) Assignee: Short Brothers PLC, Belfast (GB)

( * ) Notice: Subject to any disclaimer, the term of this patent is extended or adjusted under 35 U.S.C. 154(b) by 0 days.

(21) Appl. No.: 09/547,950

(22) Filed: Apr. 12, 2000

(30) Foreign Application Priority Data

Apr. 27, 1999 (GB) ..... 9909690

(51) Int. Cl.[7] ..... D03D 41/00
(52) U.S. Cl. ..... 139/11; 139/DIG. 1
(58) Field of Search ..... 139/11, DIG. 1

(56) References Cited

U.S. PATENT DOCUMENTS 5,540,260 * 7/1996 Mood ..... 139/11
5,775,381 * 7/1998 Addis ..... 139/11
5,947,160 * 9/1999 Addis et al. ..... 139/11

FOREIGN PATENT DOCUMENTS

1048765 * 11/2000 (EP) ..... D03D/41/00

* cited by examiner

*Primary Examiner*—John J. Calvert
*Assistant Examiner*—Robert H. Muromoto, Jr.
(74) *Attorney, Agent, or Firm*—Lyon & Lyon LLP

(57) ABSTRACT

In forming a multi-axial yarn structure a bias yarn assembly forming device makes use of cooperating yarn guide and yarn transfer members having yarn guide elements defining guide and transfer openings which hold warp yarns spaced apart in the weft direction. Warp yarn transfer from an opening in one member to an opening in the other member is facilitated by providing the guide elements of the two members with cooperating complementary salient and re-entrant inclined end portions. Furthermore, a yarn diverter blade extends from the end portion of each guide element of one of the members to hold the transferring yarns away from the junctions between the cooperating end portions of the guide elements. To facilitate insertion of binding warp yarns two sets of yarn guide and yarn transfer members are provided to hold the yarns spaced apart to form binding warp yarn insertion zones between the two sets. A yarn beat-up member carries out successive beat-up cycles in cooperation with a yarn engagement transfer member which assists the beat-up member during the beat-up cycle.

24 Claims, 12 Drawing Sheets

MULTI-AXIAL YARN STRUCTURE FORMING MACHINE

The present invention relates to a machine for forming a multi-axial yarn structure and particularly to a machine having a bias yarn assembly forming means for forming from warp yarns fed in a warp feed direction in the form of a warp sheet a non-woven bias yarn assembly comprising two superposed bias yarn sub-assemblies in which the bias yarns of one sub-assembly are inclined to the bias yarns of the other sub-assembly and in both of which the bias yarns are inclined to the warp feed direction.

A simple form of multi-axial yarn structure embodying a non-woven bias yarn assembly is shown in FIG. 1. The non-woven bias yarn assembly is composed of two superposed non-woven diagonal sub-assemblies of warp yarns 11 and 12 arranged at angles of ±45° to the reference warp direction R, a binding warp yarn assembly comprising binding warp yarns 13 extending in the warp feed direction and passing through the non-woven diagonal warp yarn sub-assemblies 11 and 12, an upper weft yarn assembly comprising weft yarns 14 and a lower weft yarn assembly comprising weft yarns 15.

The structure illustrated in FIG. 1 can be produced on a multi-axial yarn structure forming machine previously proposed in International patent application No. PCT/GB94/00028 (publication WO94/16131) and illustrated in outline in FIG. 2A. The machine comprises a creel 16 which supplies warp yarns in a warp sheet 17 in a warp feed direction F to a yarn transfer mechanism 18 following passage through yarn support elements 19 of a jacquard mechanism 20. Each warp yarn of the warp sheet 17 is supported by its own yarn support element 19 which can be raised and lowered under the control of the mechanism 20 to form sheds in which warp yarns of the warp sheet 17 are raised. Such mechanisms are well known in the art and can be used for making complex selections for the shedding of the warp sheet in the formation of fabrics of intricate pattern. The mechanism provided in the machine illustrated in FIG. 2A is employed also for raising and lowering warp yarns of the warp sheet 17 during yarn transfer carried out by the yarn transfer mechanism 18.

The yarn transfer mechanism 18 shown more clearly in FIG. 2B comprises a lower yarn guide member 21 which extends in the weft direction throughout the width of the warp sheet 17 and includes upstanding yarn guide elements 26 which (i) extend through the thickness of the warp sheet 17, (ii) define warp yarn guide openings 27 through which the warp yarns of the warp sheet 17 pass and (iii) hold the warp yarns in predetermined positions spaced apart in the weft direction and a warp yarn transfer member 22 which also extends in the weft direction and which includes spaced yarn guide elements 28 defining transfer openings 29 for the reception of yarns of the warp sheet 17 for transfer in the weft direction to produce the bias warp yarns 11 and 12 which are to form part of the yarn structure produced on the machine.

The yarn transfer mechanism 18 in the machine illustrated in FIGS. 2A and 2B subjects the warp yarns of the warp sheet 17 to successive bias yarn forming steps in which each yarn is caused to move in a succession of lateral transfer steps in a first weft direction from a first bias yarn reversal position to a second bias yarn reversal position and then to move in a succession of return lateral transfer steps in the opposite direction from the second bias yarn reversal position to the first bias yarn reversal position thereby to form two superposed non-woven bias yarn sub-assemblies as shown in FIG. 1, the bias yarns 11 of one sub-assembly being inclined to the bias yarns 12 of the other sub-assembly and at ±45° to the warp feed direction. Transfer of the bias yarns 11 and 12 by the transfer mechanism 18 is fully described in WO94/16131.

The machine shown in FIG. 2A also includes a weft insertion station 23 for inserting the weft yarns 14 and 15 of the structure shown in FIG. 1 and a binding warp yarn insertion mechanism 25 which includes an insertion needle 24 which provides for the insertion of the binding warp yarns 13 of the structure 10 shown in FIG. 1. It also includes a beater 30.

The yarn transfer mechanism 18 in the machine illustrated in FIG. 2A under the control of drive mechanism 181 serves progressively to move the warp yarns of the warp sheet 17 into superposed diagonal ±45° non-woven warp yarn sub-assemblies as represented by the warp yarns 11 and 12 of the structure shown in FIG. 1.

The yarn structure shown in FIG. 1 is formed from the two non-woven inclined bias yarns 11 and 12, the binding warp yarns 13 and the upper and lower weft yarns 14 and 15 in a succession of processing steps in a cycle of operation following each transfer step of the yarns 11 and 12 in the yarn transfer mechanism 18. Following a bias yarn transfer step in the mechanism 18 a binding warp yarn insertion step is carried out in which binding warp yarn 13 is passed through the bias yarn structure behind the bias yarns 11 and 12 by the insertion needle 24 followed by a weft insertion step in which a lower weft yarn 15 is inserted at the weft insertion station 23 behind the binding warp yarn. This is followed by a beating up step using the beater 30 to bring the bias yarns 11 and 12 and the newly inserted lower weft yarn 15 to the fell point of the yarn structure being formed. The beater 30 is then retracted and the binding warp yarn needle 24 is returned to its retracted position following which a further weft yarn insertion step is carried out by insertion of an upper weft yarn 14 behind the return run of the binding warp yarn and is followed by a further beating up step. The beater 30 is then returned to its retracted position to complete the steps in a complete cycle of operation of the machine which is then repeated by the commencement of the next yarn transfer step carried out by the transfer mechanism 18.

It will however be apparent that in the yarn transfer mechanism disclosed in WO94/16131 and hereinbefore described the yarns undergoing transfer in the forward and return transfer steps are required to move between the openings in the yarn guide member and the yarn transfer member many times in order to complete the succession of forward transfer steps followed by the succession of return transfer steps. As a consequence, it has been found that despite efforts to bring the gaps between opposing guide elements 26 and 28 to minimum tolerances, the warp yarns suffer abrasion when transferred from one member to the other and in some instances snag causing end breaks requiring shutdown of the machine of which the transfer mechanism forms part.

In International patent application No. PCT/GB95/01921 (publication No. WO96/06213) there is proposed a yarn transfer mechanism which does not require contact of the yarns with the guide elements in their transfer between the yarn guide member and the yarn transfer member. The transfer mechanism includes a plurality of eyelet elements through which the warp yarns of the warp sheet pass from a supply side of the mechanism to an opposite delivery side of the mechanism and which are supported by the guide elements for sliding movement along the elements into and out of the yarn guide and yarn transfer openings and with the yarn transfer member in any one of the registering positions for sliding movements from one opening in one member into a registering opening in the other member.

While the eyelet elements proposed for use in the yarn transfer mechanism disclosed in WO96/06213 solves the problem of excessive abrasion or snagging of the yarns when being transferred from one member to the other there is the disadvantage that use is limited to arrangements in which the eyelet size is not so small as to give rise to difficulties of manufacture and to operational and wear resistance problems.

It has however been found that weaving efficiency can be improved by increasing the number of binding warp yarns in the yarn structure and that the thickness of the guide elements and the distance between them need to be reduced.

A reduction in the spacing of the openings makes the use of eyelet elements impracticable and the problems of yarn abrasion and snagging reappears without their use.

Furthermore, a reduction in the thickness of the guide elements gives rise to a substantial reduction in their stiffness and a consequent flexing of the guide elements under side loads imposed by the yarns. Abrasion and snagging of yarns during transfer from one member to the other can then become a serious problem.

It is an object of the present invention in accordance with one of its aspects to provide a multi-axial yarn forming machine having a bias yarn assembly forming means which makes use of cooperating yarn guide and yarn transfer members having guide elements of reduced thickness but which in use do not give rise to or do not give rise to the same extent to abrasion and snagging of the yarns during transfer from one member to the other.

According to a first aspect of the present invention there is provided a machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

a yarn guide member having a support portion extending in the weft direction and a plurality of guide elements which extend laterally from the support portion to form a row of equi-spaced guide elements which terminate in ends lying on a line extending in the weft direction and which define between pairs of adjacent guide elements warp yarn guide openings through which warp yarns of the warp sheet are caused to pass and by which the warp yarns are confined to predetermined relative positions therein along the weft direction a yarn transfer member having a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which warp yarns of the warp sheet are transferred and by which the warp yarns are confined to predetermined relative positions therein along the weft direction, yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements of the yarn guide member and in which transfer openings in the yarn transfer member register with yarn guide openings in the yarn guide member and shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings characterised in that:

each guide element of one of the members has an end portion which includes or is formed as a salient end portion, each guide element of the other of the members has an end portion which includes or is formed as a re-entrant end portion, the salient and re-entrant end portions of the guide elements are complementary and such as to engage each other at each of the transfer positions and to bring registering guide elements into inter-engaging alignment in the weft direction upon a predetermined engaging movement of the yarn transfer member, and the yarn transfer drive means is such as to cause the yarn transfer member to carry out the predetermined engaging movement upon advancement of the yarn transfer member to the transfer position and to cause the transfer member to carry out a predetermined disengaging movement upon withdrawal of the yarn transfer member from the transfer position.

In an embodiment of the invention according to its first aspect and as hereinafter to be described:

each guide element is of rectangular or square cross-section with side faces which define the transfer and guide openings and which extend from the support portion and front and rear faces which extend from the support portion, the salient end portion of each guide element has converging end face portions which extend from the side faces of the guide element and which converge in a direction away from the support portion, and the re-entrant end portion of each guide element has diverging end face portions which extend toward the side faces of the guide element and which diverge in a direction away from the support portion.

In an embodiment of the invention according to its first aspect and as hereinafter to be described, the salient end portion of each guide element extends across the guide element from the front face to the rear face of the element in a direction parallel to the side faces of the guide element and at an angle inclined to the warp feed direction and in each of the transfer positions opposes a complementary inclined re-entrant end portion of a registering guide element. The shedding means is then such as to shed the selected warp yarns to form a shed, the shed angle of which is not coincident with the angle of inclination of the salient and re-entrant end portions to the warp feed direction.

In a specific embodiment of the invention according to its first aspect and as hereinafter to be described, the lines of intersection of the end face portions of the salient and re-entrant end portions with the associated side faces of the guide element are parallel to each other and to their line of intersection with each other.

In the embodiments of the invention according to its first aspect and as hereinafter to be described, the end face portions of the salient and re-entrant end portions form the entirety of the end faces of the guide elements, although in alternative embodiments the end face portions may form part only of the end faces of the guide elements which then include further end face portions.

Preferably, the converging end face portions of the salient end portion of each guide element are equally inclined to the associated side faces of the guide element.

The provision of inter-engaging end portions of the guide elements of the yarn guide and yarn transfer members in the multi-axial yarn structure forming machine according to the first aspect of the invention has the following advantages:

(a) The inter-engaging alignment of the guide elements enables the elements to resist higher side loading by yarns being traversed from one member to the other without giving rise to misalignment and the consequent abrasion and snagging of the traversing yarns.

(b) As a consequence of the resistance to higher side loads the thickness of the guide elements can be substantially reduced without giving rise to misalignment.

(c) A small amount of flexing of the inter-engaging elements can be tolerated without losing their alignment with each other.

(d) A small amount of misalignment of the registering elements prior to inter-engagement can be tolerated as this is corrected by self-alignment during the predetermined engaging movement of the yarn transfer member.

(e) A substantial reduction in yarn abrasion and snagging is achieved by arranging for the salient and re-entrant end portions of the guide elements to be inclined to the warp feed direction and for the transfer of yarns to be carried out to a shed angle which is not coincident with the angle of inclination of the salient and re-entrant end portions.

It will however be apparent that there still remains the possibility of yarn abrasion and snagging at the exposed junctions along the side faces of the registering guide elements particularly at the end of the junction where the yarns are fed to the openings at an angle inclined to the side faces of the registering guide elements.

It is an object of the invention according to another of its aspects to provide a multi-axial yarn forming machine having a bias yarn assembly forming means which makes use of cooperating yarn guide and yarn transfer members having guide elements, the construction of which still further reduces the risk of abrasion and snagging of the yarns during transfer of yarns from one member to the other.

According to a second aspect of the present invention there is provided a machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

a yarn guide member having a support portion extending in the weft direction and a plurality of guide elements which extend laterally from the support portion to form a row of equi-spaced guide elements which terminate in ends lying on a line extending in the weft direction and which define between pairs of adjacent guide elements warp yarn guide openings through which warp yarns of the warp sheet are caused to pass and by which the warp yarns are confined to predetermined relative positions therein along the weft direction a yarn transfer member having a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which warp yarns of the warp sheet are transferred and by which the warp yarns are confined to predetermined relative positions therein along the weft direction, yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements in the yarn guide member and in which transfer openings of yarn transfer member register with yarn guide openings in the yarn guide member and shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings wherein:

each guide element is of rectangular or square cross-section with side faces which define the transfer or guide openings and which extend from the support portion and front and rear faces which extend from the support portion, and each guide element of each of the members has an end portion with an end face whereby the end faces of the end portions of registering guide elements are brought into engagement with or in close proximity to each other at each of the transfer positions and define exposed side junctions at the side faces of the registering guide elements to be traversed by yarns traversed between the yarn guide and yarn transfer openings characterised in that:

a yarn diverter blade is provided which extends from the end portion of each guide element of one of the members at the rear face of the guide element and in a direction away from the support portion of the member to hold the yarns away from the exposed side junctions as the yarns are traversed between the yarn guide and yarn transfer openings.

In an embodiment of the invention according to its second aspect and as hereinafter to be described, the yarn diverter blade extends to a maximum width no greater than the maximum width of the guide element between the two side faces, and the end portion of each guide element of each of the members is so constructed as to form at each of the transfer positions exposed side junctions between registering guide elements which lie at locations inside the boundaries of the side faces of the registering guide elements.

It will be apparent that the yarn diverter blades provided at the ends of the guide elements of the guide member serve to shield the incoming yarns from the side junctions between the ends of the registering guide elements by holding them away from the side junctions and that this can be achieved either by providing a diverter blade of a width greater than that of the guide element at the junction or by reducing the width of the guide elements at their ends so that the side junctions between registering guide elements lie within the boundaries of the yarn diverter blade.

The multi-axial yarn structure forming machine illustrated in FIG. 2A produces the yarn structure shown in FIG. 1 in a succession of processing steps which includes a binding warp yarn insertion step in which binding warp yarns 13 are passed through the bias yarn structure behind the bias yarns 11 and 12 by the insertion needles 24. FIG. 2A is a diagrammatic representation of the machine and does not readily make apparent the difficulty in providing sufficient space bounded by the guide member 21 and the oppositely inclined bias yarns 11 and 12 for insertion of the insertion needle 24 carrying the binding warp yarn 13. Additionally, the available space is not a clearly defined space as it can vary with yarn tensions.

It is an object of the present invention according to yet another of its aspects to provide in a machine for forming a multi-axial yarn structure a bias yarn assembly forming means which provides a binding warp yarn insertion zone for the insertion of binding warp yarns which does not suffer from the space limitations provided in a machine constructed as proposed by reference to FIG. 2A.

According to a third aspect of the present invention there is provided a machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

yarn guide means defining yarn guide openings through which the warp yarns of the warp sheet are caused to pass and which hold the warp yarns in predetermined relative positions along the weft direction, and yarn transfer means defining yarn transfer openings and being located at a predetermined initial yarn receiving position with respect to the yarn guide means, shedding means between the warp yarn supply means and the yarn guide means for shedding selected warp yarns to transfer the selected yarns from predetermined openings in the yarn guide means to yarn transfer openings in the yarn transfer means at the initial yarn receiving position, yarn transfer drive means to cause relative displacement of the yarn transfer means and the yarn guide means in the weft direction to bring the yarn transfer means to an offset position offset from the yarn receiving position and thereby to bring the selected warp yarns upon their return to the warp sheet into openings in the yarn guide means offset from the predetermined openings in the yarn guide means and drive control means to drive the shedding means and the yarn transfer drive means successively to transfer each yarn from the opening it occupies in the yarn guide means to another opening in the yarn guide means to produce the non-woven bias yarn assembly, characterised in that:

(i) the yarn guide means comprises first and second yarn guide members each having yarn guide openings through which warp yarns of the warp sheet are caused to pass and by which the warp yarns are confined to predetermined relative positions therein along the weft direction, (ii) the yarn transfer means comprises first and second yarn transfer members each having yarn transfer openings to which warp yarns of the warp sheet are transferred from the first yarn guide member and by which the warp yarns are confined to predetermined relative positions therein along the weft direction, (iii) the second yarn guide member is of the same form as the first guide member and is so disposed that the warp yarns of the warp sheet pass through openings in the second guide member prior to passage through corresponding yarn guide openings of the first yarn guide member, (iv) the second yarn transfer member is of the same form as the first yarn transfer member and is so disposed that the warp yarns of the warp sheet are transferred from the second yarn guide member to openings in the second yarn transfer member in the same manner as the transfer of the warp yarns from the first guide member to the first transfer member, and (v) the disposition of the second yarn guide member and the second yarn transfer member in relation to the first yarn guide member and the first yarn transfer member is such as to provide a binding warp yarn insertion zone between the first yarn guide and transfer members and the second yarn guide and transfer members, and (vi) binding warp yarn insertion means is arranged to insert at the insertion zone binding warp yarns into the warp yarn assembly in the zone.

In an embodiment of the invention according to its third aspect and as hereinafter to be described the machine is so constructed that:

(i) the first and second yarn guide members each have a support portion extending in the weft direction and a plurality of guide elements which extend laterally from the support portion to form a row of equi-spaced guide elements which terminate in ends lying on a line extending in the weft direction and which define between pairs of adjacent guide elements the yarn guide openings, (ii) the first and second yarn transfer members each have a support portion extending in the weft direction and a plurality of guide elements which extend laterally from the support portion to form a row of equi-spaced guide elements which terminate in ends lying on a line extending in the weft direction and which define between pairs of adjacent guide elements the yarn transfer openings.

Additionally, the first and second yarn guide members and the first and second yarn transfer members may be constructed with features made the subject of the machine in accordance with the first and/or second aspects of the invention.

The transfer of the bias yarns 11 and 12 by the transfer mechanism 18 in the machine schematically illustrated in FIG. 2A and fully described in WO94/16131 has been found to have the disadvantage that the binding warp yarns which serve to hold the bias yarns of the bias yarn sub-assemblies in place in the structure may in some circumstances not adequately prevent the yarn structure being formed from reducing in width under the tensions developed in the bias yarns.

To overcome the above disadvantage there has been proposed in International patent application No. PCT/GB96/00238 (publication No. WO96/247713) the provision of a loop holding mechanism for engaging and holding loop portions of bias yarns successively produced at opposite side edges of the multi-axial yarn structure being formed.

The loop holding mechanism of the machine disclosed in WO96/247713 is of complex form involving a multiplicity of moving pin blocks which are arranged successively to engage the loop portions and traverse with them in a direction away from the fell of the yarn structure being formed thereby to hold the bias yarns in place and prevent a reduction in the width of the fabric arising from the adverse effects of tension in the bias yarns.

While the loop holding mechanism of the machine disclosed in WO96/247713 adequately serves the purpose of preventing a reduction in fabric width there is a need for an alternative means for maintaining the fabric at full width.

It is an object of the present invention in yet another of its aspects to provide in a machine for forming a multi-axial yarn structure an alternative means by which a reduction in fabric width is prevented or resisted.

According to a fourth aspect of the present invention, there is provided a machine for forming a multi axial yarn structure comprising:

supply means for supplying in a warp feed direction warp yarns in the form of a warp sheet, a bias yarn assembly forming device for forming in a succession of bias yarn forming steps in which warp yarns of the warp sheet are displaced in opposite weft directions a non-woven bias yarn assembly comprising two or more superposed non-woven bias yarn sub-assemblies in which the bias yarns of one sub-assembly are inclined to the bias yarns of the other sub-assembly and in each of which the bias yarns are inclined to the feed direction, binding warp yarn insertion means for passing in each of a succession of binding warp yarn inserting steps binding warp yarns into the non-woven warp yarn assembly, weft insertion means for passing in the weft direction in each of a succession of weft insertion steps a holding weft yarn to hold the binding warp yarns captive in the yarn structure and beater means for beating up the yarns of the superposed sub-assemblies, the binding warp yarns and the holding weft yarns to produce a three dimensional yarn structure, in which the yarns of the superposed sub-assemblies are held in place in the structure by the binding warp yarns which are held by the holding weft yarns, wherein:

the beater means comprises a yarn beat up member having a support portion extending in the weft direction and a plurality of guide elements which extend laterally from the support portion to form a row of equi-spaced guide elements which terminate in ends lying on a line extending in the weft direction and which define between pairs of adjacent guide elements guide openings in which yarns are received during predetermined beat up displacements of the yarn beat up member and in which the yarns are confined to predetermined relative positions therein along the weft direction, and beater drive means to cause in predetermined beat up cycles the predetermined beat up displacement of the yarn beat up member to bring the guide elements of the yarn beat up member to a beat up location at the fell of the yarn structure being formed and the yarns of the non-woven bias yarn sub-assemblies, the binding warp yarns and the weft yarns to the fell of the yarn structure characterised in that:

the beater means further comprises a yarn engagement transfer member which is located at the beat up location and which comprises a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which yarns from the yarn beat up member are transferred during a predetermined transfer displacement of the yarn beat up member and the yarn engagement transfer member at the beat up location, and the beater drive means is arranged to cause the predetermined beat up displacement of the yarn beat up member and the predetermined transfer displacement of the yarn beat up member and the yarn engagement transfer member in each of the predetermined beat up cycles in which:

(i) the yarn beat up member is caused to carry out at a beater insertion location a beater engagement displacement in which the guide elements of the yarn beat up member move from a retracted position to a yarn engagement position in which yarns take up positions in the yarn guide openings, (ii) the yarn beat up member is caused to carry out the predetermined beat up displacement in which it moves from the yarn engagement position at the beater insertion location to a yarn engagement position at the beat up location (iii) the yarn engagement transfer member is caused to carry out before completion of the predetermined beat up displacement of the yarn beat up member a withdrawal displacement in which it moves from a yarn engagement position at the beat up location in which it engages yarns at the beat up location and which it occupies at the end of a previous beat up cycle to a retracted position at the beat up location (iv) the yarn beat up member at the yarn engaging position at the beat up location and the yarn engagement transfer member at the retracted position at the beat up location take up a predetermined registering disposition in which the ends of the guide elements of the yarn beat up member oppose and register with the ends of the guide elements of the yarn engagement transfer member, and (v) the yarn beat up member and the yarn engagement transfer member are caused to carry out in their predetermined registering disposition the predetermined transfer displacement in which the yarn beat up member moves from the yarn engagement position to a retracted position and the yarn engagement transfer member moves from its retracted position to the yarn engagement position.

In an embodiment of the invention according to its fourth aspect, the yarn beat up member is caused to carry out a predetermined beater return displacement in which it moves from its retracted position at the beat up location to its retracted position at the beater insertion location to commence or complete the cycle.

In an embodiment of the invention according to its fourth aspect and as hereinafter to be described, each guide element is formed in accordance with the first and/or second aspect of the invention.

In a specific embodiment of the invention according to its fourth aspect:

each guide element of one of the members has an end portion which includes or is formed as a salient end portion, each guide element of the other of the members has an end portion which includes or is formed as a re-entrant end portion, and the salient and re-entrant end portions of the guide elements are complementary and such as to engage each other at the predetermined registering disposition and to bring registering guide elements into alignment in the weft direction upon movement of the yarn beat up member to the predetermined registering disposition.

Furthermore, in the specific embodiment:

each guide element is of rectangular or square cross-section with side faces which define the guide and transfer openings and which extend from the support portion and front and rear faces which extend from the support portion, the salient end portion of each guide element has converging end face portions which extend from the side faces of the guide element and which converge in a direction away from the support portion, and the re-entrant end portion of each guide element has diverging end face portions which extend toward the side faces of the guide element and which diverge in a direction away from the support portion.

Additionally or alternatively, the machine according to the fourth aspect of the invention is so constructed that each guide element is of rectangular or square cross-section with side faces which define the transfer or guide openings and which extend from the support portion and front and rear faces which extend from the support portion, each guide element of each of the members has an end portion with an end face whereby the end faces of the end portions of registering guide elements are brought into engagement with or in close proximity to each other at the predetermined registering disposition and define exposed side junctions at the side faces of the registering guide elements traversed by yarns during the predetermined transfer displacements, and a yarn diverter blade is provided which extends from the end portion of each guide element of one of the members at the rear face of the guide element and in a direction away from the support portion of the member to hold the yarns away from the exposed side junctions as the yarns are traversed between the yarn guide and yarn transfer openings of the yarn beat up member and the yarn engagement transfer member.

Embodiments of the invention will now be described by way of example with reference to the accompanying drawings in which.

Figure 1:
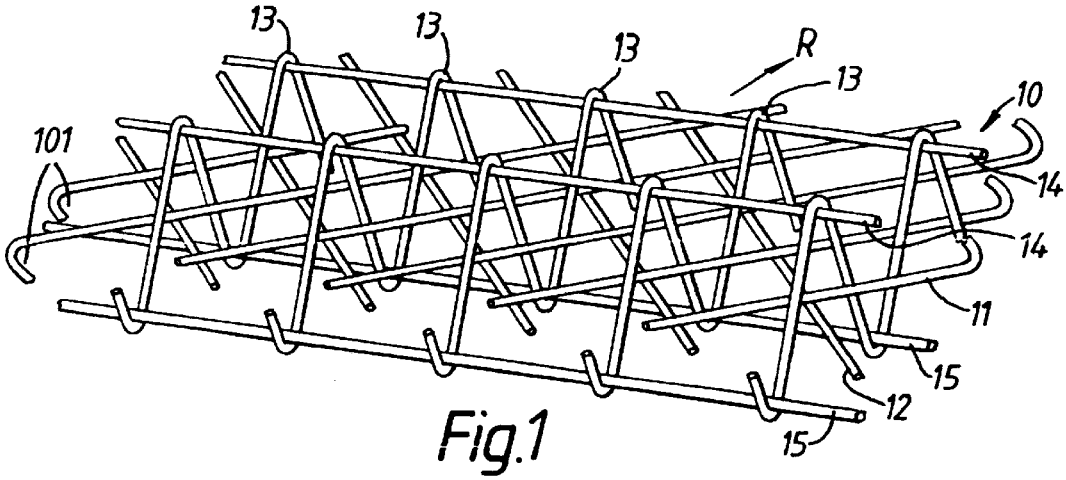
FIG. 1 (hereinbefore referred to) is a schematic isometric view of a simple multi-axial yarn structure which can be produced on the multi-axial yarn structure forming machine illustrated in FIG. 2A.
Figure 2A:
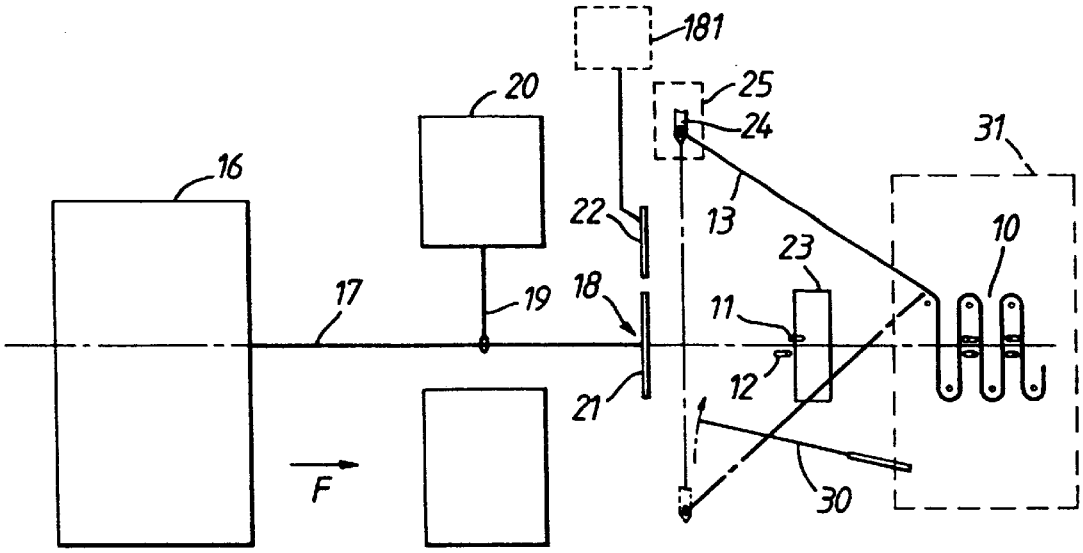
FIG. 2A (hereinbefore referred to) is a block schematic diagram of a multi-axial yarn structure forming machine described in WO94/16131.
Figure 2B:
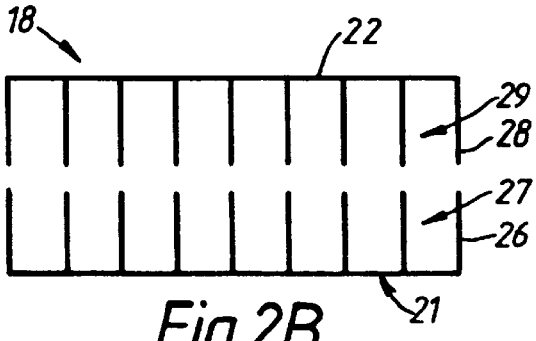
FIG. 2B (hereinbefore referred to) is a schematic diagram of a yarn transfer mechanism of the machine shown in FIG. 2A.
Figure 5A:
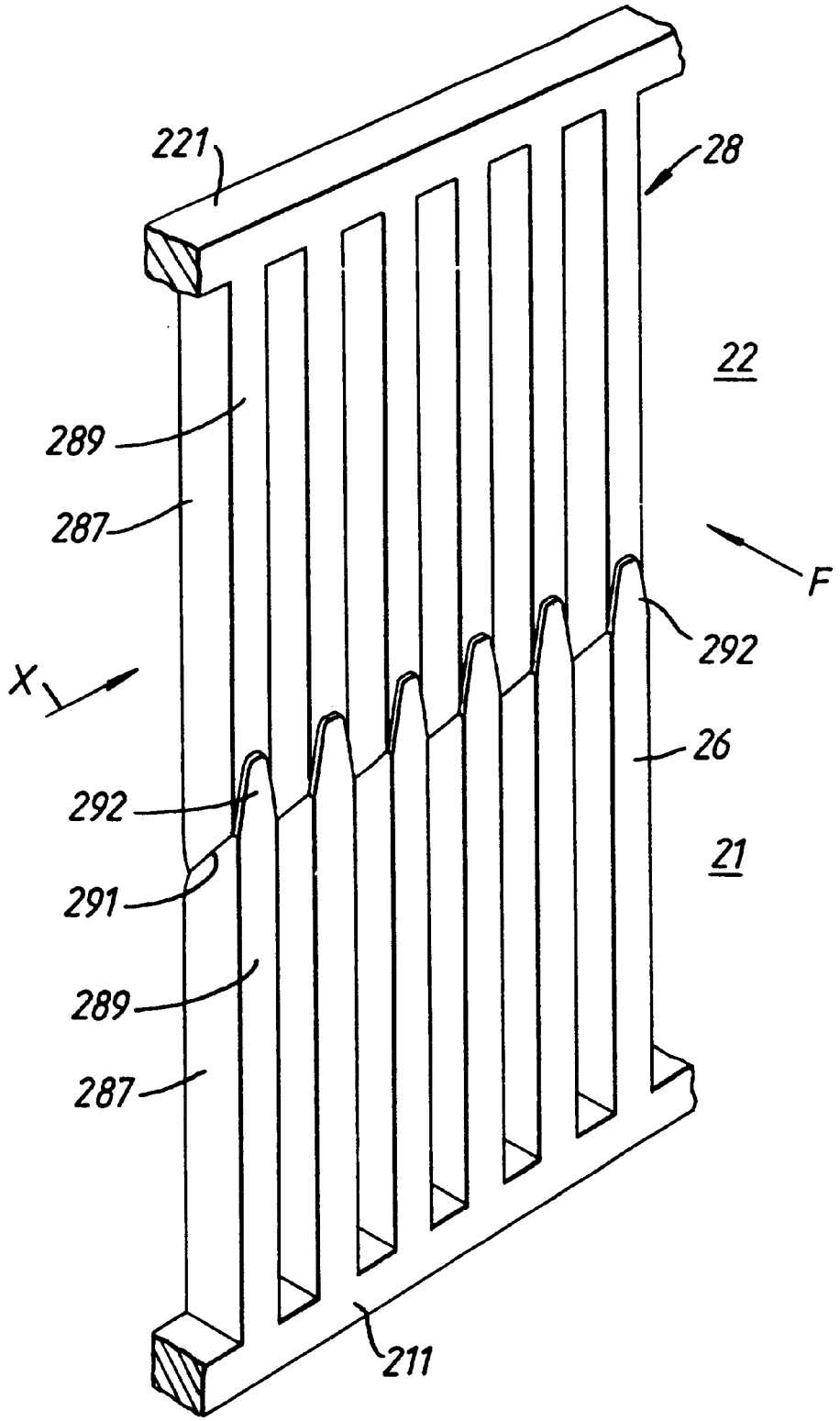
FIG. 5A is a schematic isometric part view of the yarn guide and transfer members of the yarn transfer mechanism shown in FIG. 4A, which is viewed along the feed direction and which is further modified to provide yarn diverter blades according to the second aspect of the invention.
Figure 6A:
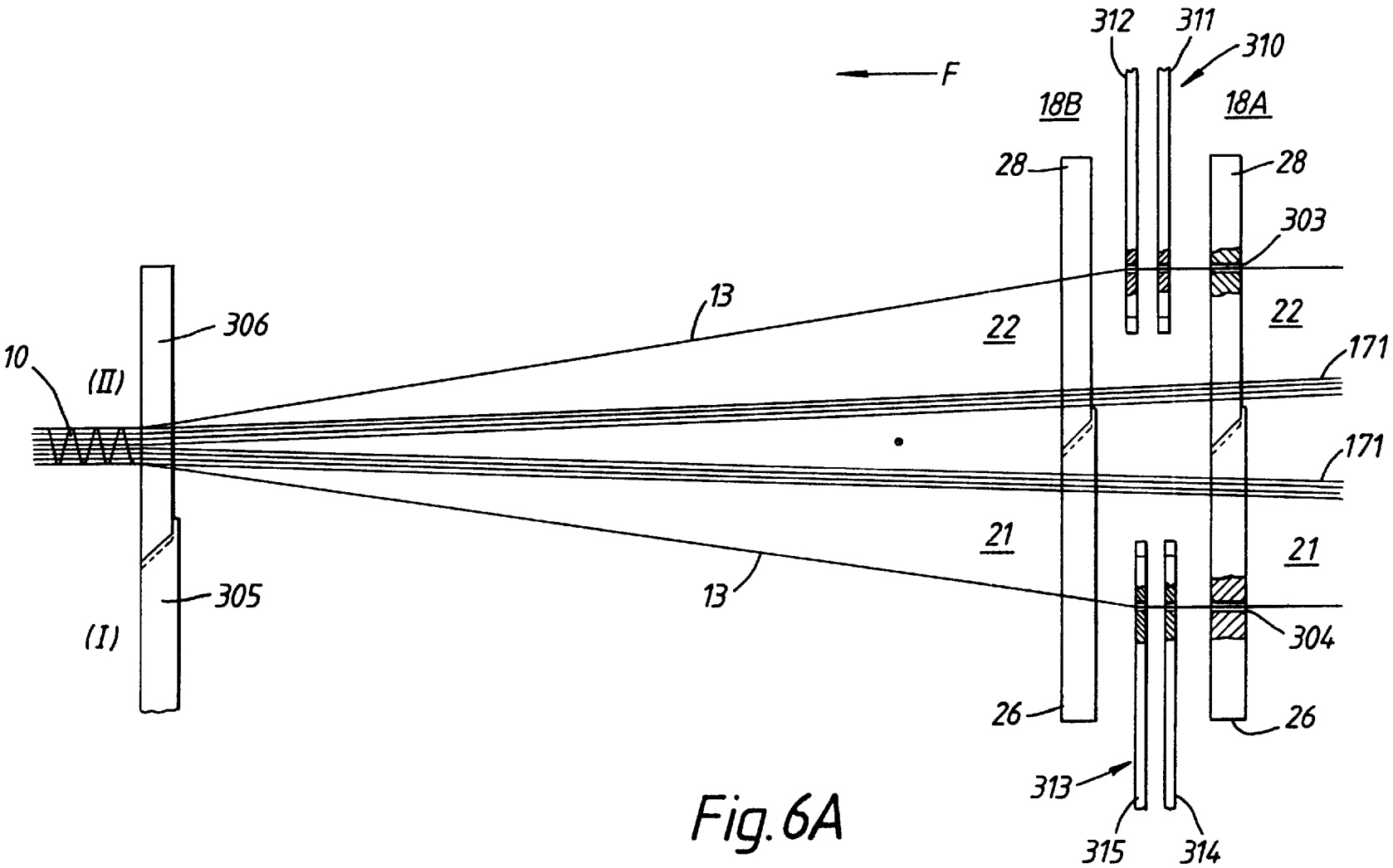

FIG. 6A is a schematic side view of a part of the multi-axial yarn structure forming machine shown in FIG. 2 and as modified to provide spaced yarn transfer mechanisms having first and second yarn guide and yarn transfer members, which take the form illustrated in FIG. 5A and which are so disposed as to provide a binding warp yarn insertion zone for the insertion of binding warp yarns by binding warp yarn needle assemblies in accordance with the third aspect of the invention.

Figure 6B:
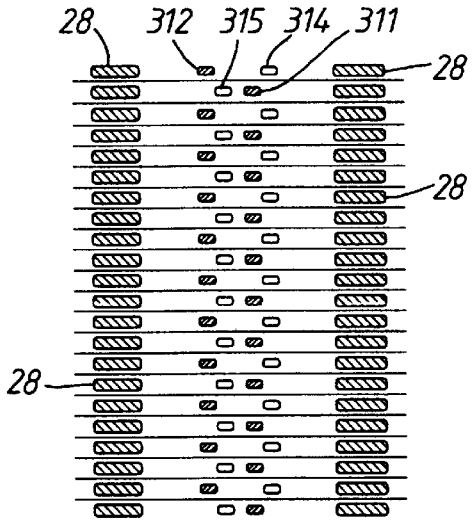

FIG. 6B is a schematic cross-section showing the disposition of the binding warp yarn needle assemblies in relation to the guide elements of the yarn guide and yarn transfer members of the transfer mechanisms as shown in FIG. 6A.

Figure 6C:
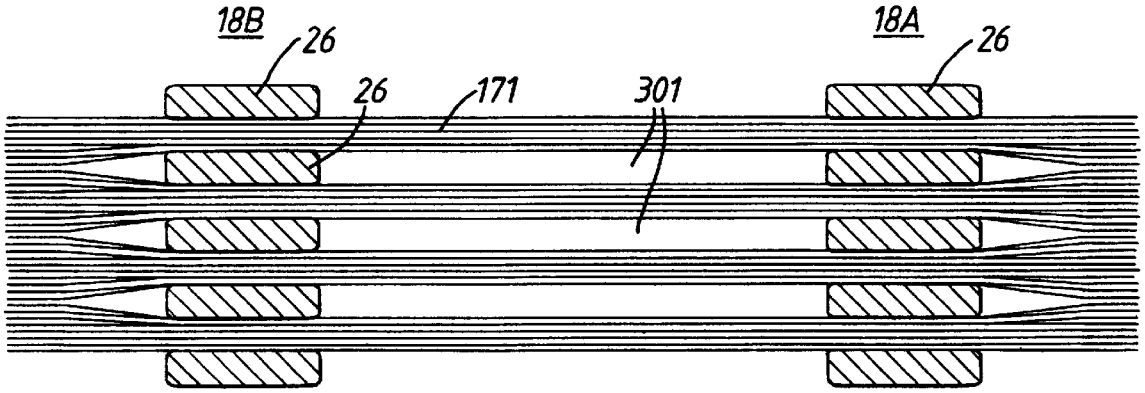

FIG. 6C is a schematic cross-section through the yarn transfer mechanisms of the machine illustrated in FIG. 6A and showing the provision of a binding warp yarn insertion zone between the two mechanisms.

Figure 6D:
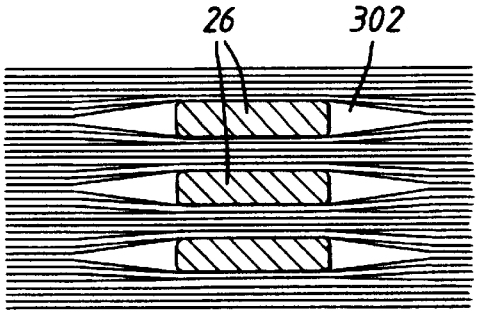

FIG. 6D is a schematic cross-section showing a restricted binding warp yarn insertion zone in an arrangement which makes use of only one yarn transfer mechanism.

Figure 7:
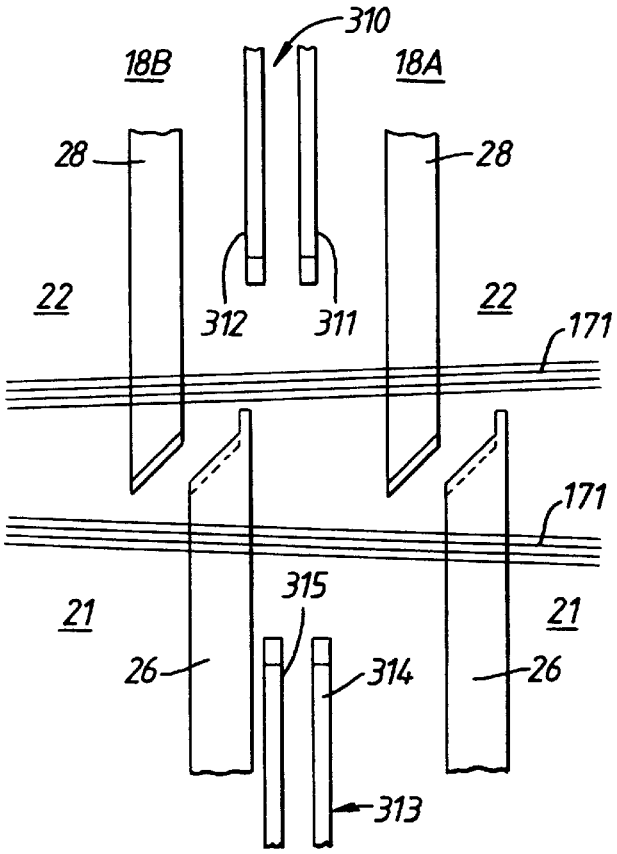

FIG. 7 is a schematic scrap view showing a displacement of the guide elements of the yarn guide members of the two yarn transfer mechanisms shown in FIG. 6A to bring the salient and re-entrant end portions of the guide elements out of engagement.

Figure 8:
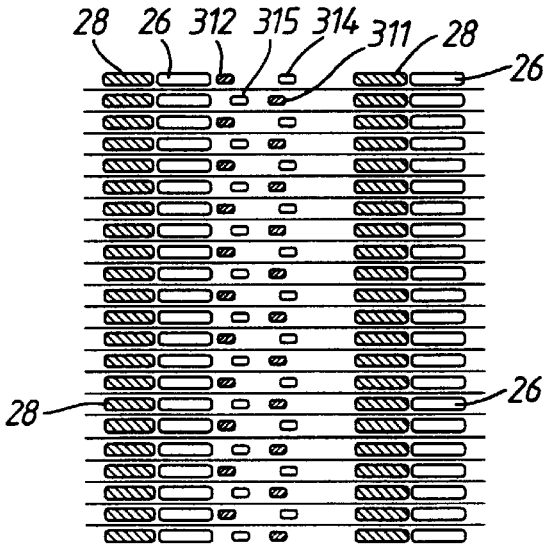

FIG. 8 is a schematic cross-section showing the disposition of the guide elements in FIG. 7 as well as the disposition of the binding warp yarn needle assemblies.

FIGS. 9 to 12 are schematic cross-sections of the guide elements and needle assemblies shown in FIGS. 7 and 8 at successive stages in a transfer of selected yarns by the mechanisms of the machine shown in FIG. 6A.

Figure 13A:
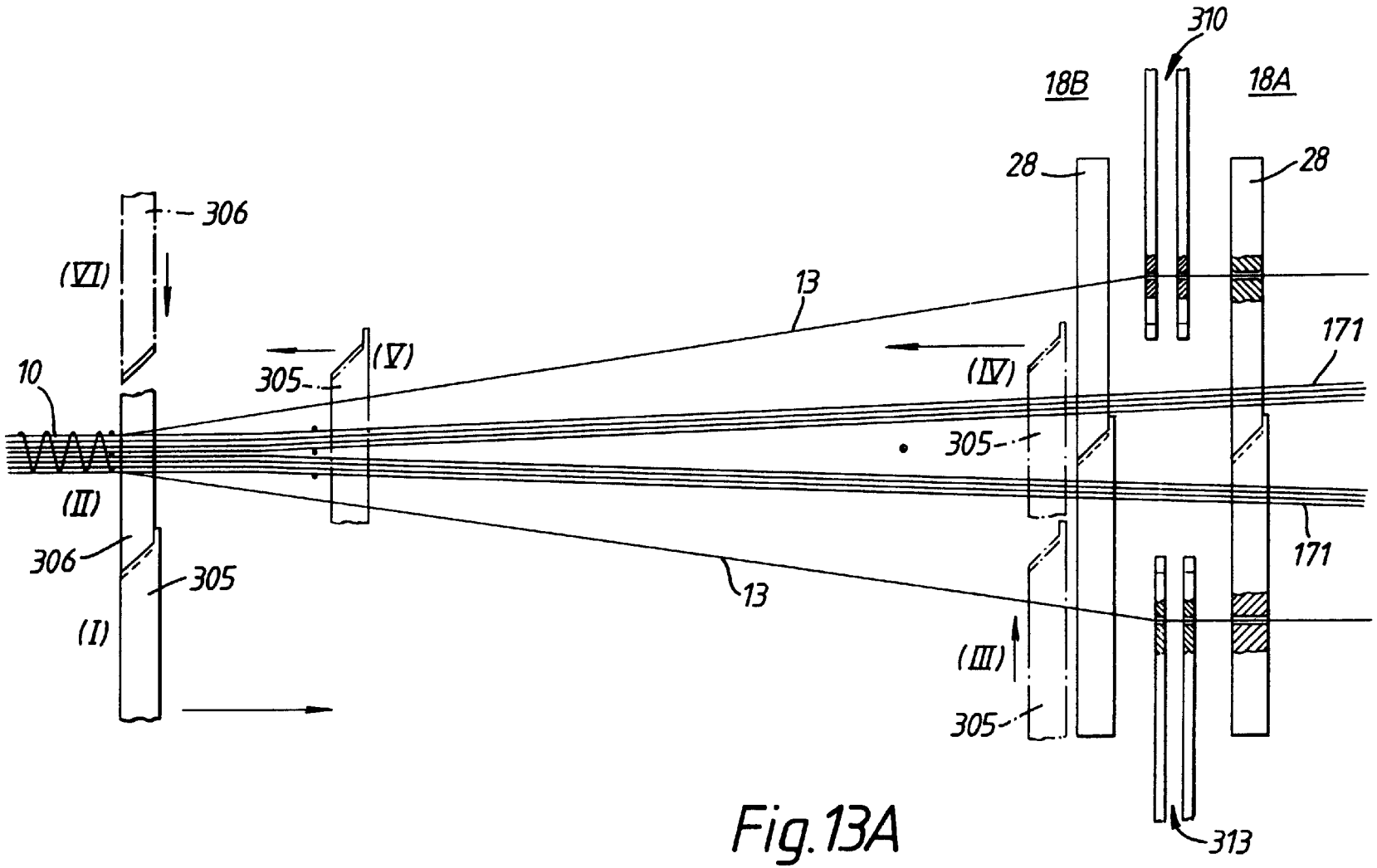

FIG. 13A is a schematic side view of a part of the multi-axial yarn structure forming machine shown in FIG. 2A and as modified to provide in accordance with the fourth aspect of the invention a beater assembly in which a yarn beat up member upon reaching a beat up location at the fell of the yarn structure cooperates with a yarn engagement transfer member which then supports the yarns at the beat up location.

Figure 13B:
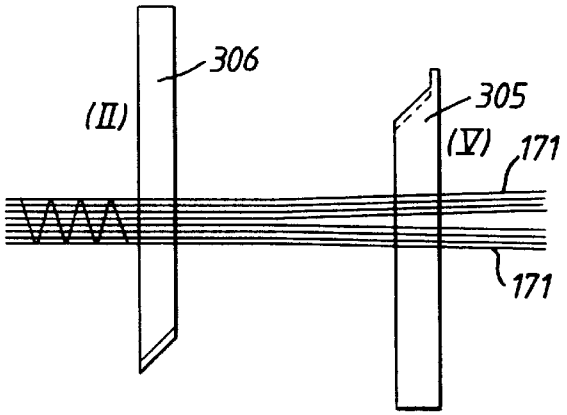

FIG. 13B is a schematic scrap view of the beat up and yarn engagement transfer members of the beat up assembly shown in FIG. 13A, with the beat up member at an intermediate position in its beat up displacement.

Figure 13C:
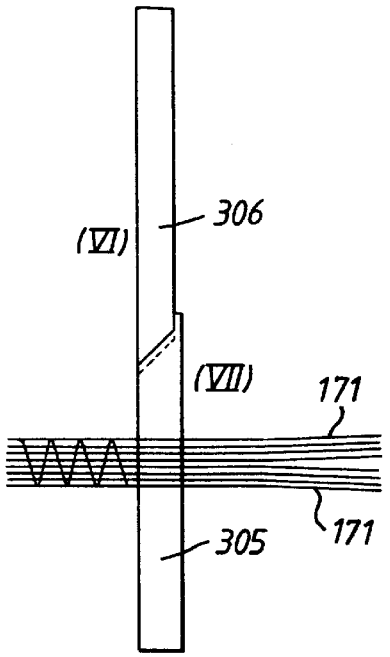

FIG. 13C is a schematic scrap view of the beat up member and the yarn engagement transfer member of the beat up assembly shown in FIG. 13A in a registering disposition in the beat up cycle.

Figure 13D:
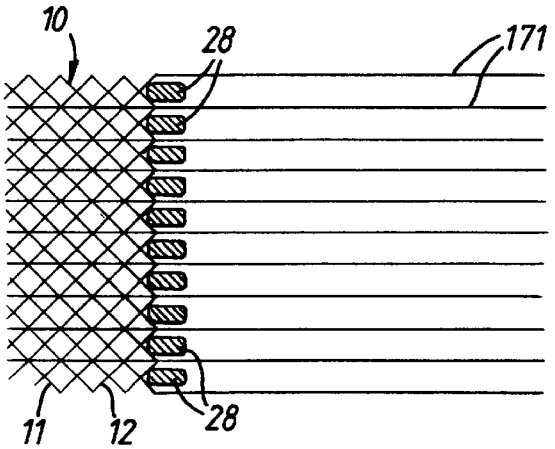

FIG. 13D is a schematic cross-section illustrating the disposition of the yarn engagement transfer member at its engagement position at the beat up location and the yarn structure in the region of the beat up location.

Figure 3:
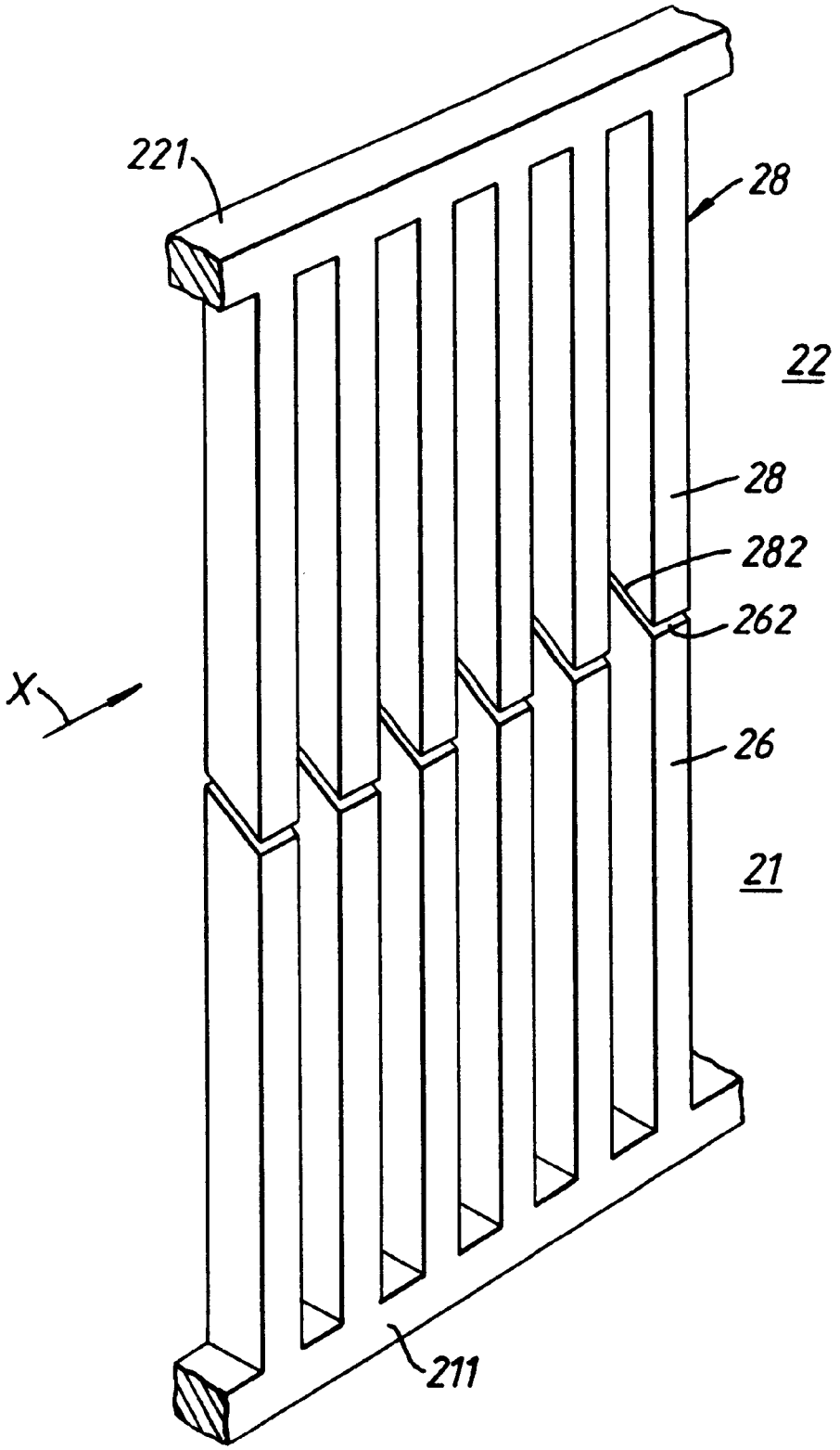
FIG. 3 is a schematic isometric part view of the yarn guide and transfer members of the yarn transfer mechanism shown in FIG. 2B, with the guide elements as proposed for use in the yarn transfer mechanism described in WO96/06213.

In the yarn transfer mechanism shown in FIG. 3, the guide elements 26 of the yarn guide member 21 are of rectangular cross-section and form a row of equi-spaced guide elements lying in a vertical plane extending in the weft direction and extending from a support portion 211. While only six of the guide elements 26 are shown in FIG. 3, it will be appreciated that for most purposes a large plurality of such guide elements would be required in the production of a bias yarn assembly of practical use, for example, in the formation of a reinforcing fabric for an aircraft composite structural element.

It will furthermore be seen that the guide elements 28 of the yarn transfer member 22 are of rectangular cross-section and have the same dimensions and dispositions as the guide elements 26 of the yarn guide member 21. As illustrated, they extend from a support portion 221 and form a row of guide elements which lie in a vertical plane which extends in the weft direction and which is co-planar with the vertical plane of the guide elements 26.

The yarn guide member 21 in the mechanism illustrated in FIG. 3 is arranged to be a stationary member and the yarn transfer drive mechanism 181 is provided for the displacement of the yarn transfer member 22 in the weft direction X to bring the elements 28 of the transfer member 22 to any one of a plurality of transfer positions.

In addition, it will be seen from FIG. 3 that the end of each guide element 26 terminates in an inclined end face 262 which in the position shown in FIG. 3 opposes a complementary inclined end face 282 on the end of a registering guide elements 28 of the yarn transfer member 22.

The yarn guide member 21 and the yarn transfer member 22 shown in FIG. 3 are proposed for use in a yarn transfer mechanism as disclosed in WO96/06213 with eyelet elements (not shown) through which the warp yarns are arranged to pass and which are supported by the guide elements 26, 28 for sliding movement along the guide elements and which protect the yarns during movement from one opening in one member into a registering opening in the other member.

Any substantial reduction in the spacing of the openings between the adjacent guide elements makes the use of eyelet elements impracticable, but without their use the problems of yarn abrasion and snagging reappears.

Furthermore, the reduction in the thickness of the guide elements gives rise to a substantial reduction in their stiffness and a consequent flexing of the guide elements under side loads imposed by the yarns. Abrasion and snagging of yarns during transfer from one member to the other can then become a serious problem.

Figure 4A:
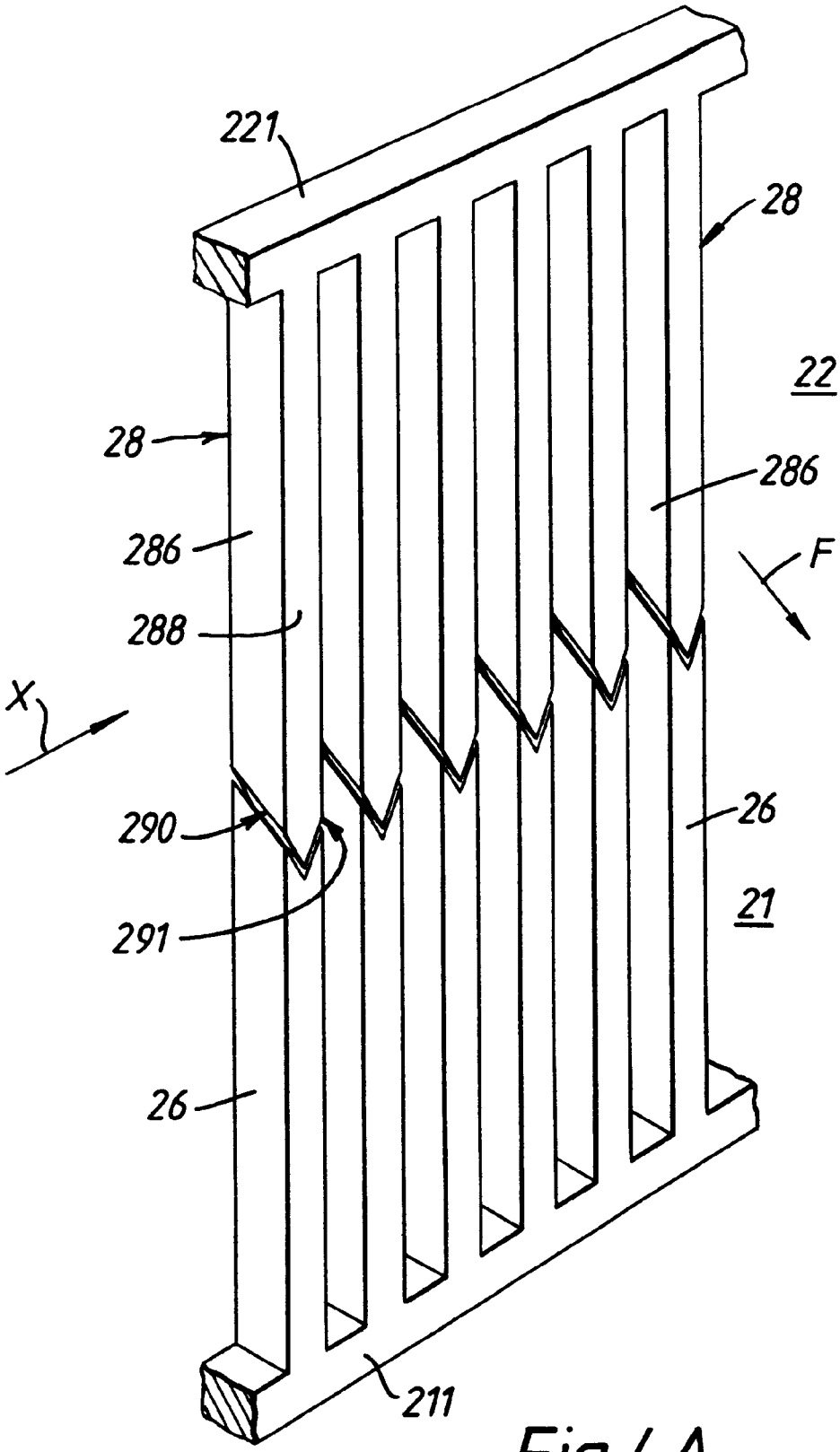
FIG. 4A is a schematic isometric part view of the yarn guide and transfer members of the yarn transfer mechanism shown in FIG. 3 which has been modified in accordance with the first aspect of the invention to provide on the guide elements salient and re-entrant end portions for bringing registering guide elements into inter-engaging alignment.
Figure 4B:
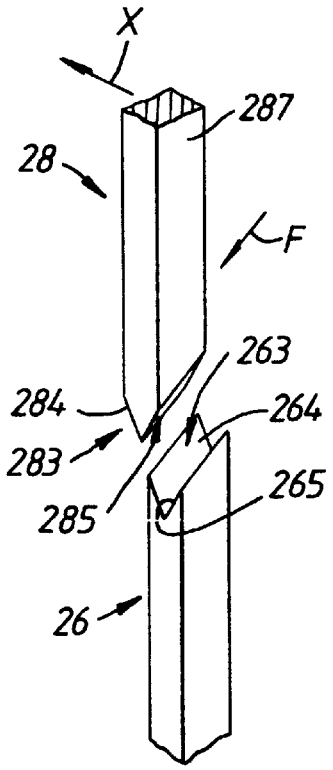
FIG. 4B is a schematic isometric scrap view showing the salient and re-entrant end portions of two of the cooperating guide elements of the yarn guide and transfer members shown in FIG. 4A.

Turning now to FIG. 4A and FIG. 4B, it will be seen that the guide elements 28 of the yarn transfer member 22 are formed with salient end portions 283 having converging end face portions 284 and 285 which extend from the side faces 286 and 287 of the guide elements 28. Furthermore, the ends of the guide elements 26 of the yarn guide member 21 are formed with complementary re-entrant end portions 263 with diverging end face portions 264 and 265.

The salient end portion 283 of each guide element 28 extends across the guide element 28 from the front face to 288 to a rear face 289 in a direction parallel to the side faces 286 and 287 and at an angle inclined to the warp feed direction F and in each of the transfer positions, one of which is shown in FIG. 4A, opposes a complementary inclined re-entrant end portion 263 of a registering guide element 26 on the yarn guide member 21.

It will be apparent that in bringing the yarn transfer member 22 from the transfer position shown in FIG. 4A to a new transfer position in which the yarn transfer member 22 is displaced in the weft direction, it is necessary to provide for either the transfer member 22 or the guide member 21 first to carry out a predetermined disengaging movement. For example, the guide member 21 needs to be moved an amount in a direction opposite to the warp feed direction F sufficient to bring the salient end portions 283 of the guide elements 28 on the transfer member 22 clear of the re-entrant end portion 263 of the guide elements 26 on the yarn guide member 21 and that following a predetermined movement of the yarn transfer member 22 in the weft direction X to carry out a predetermined engaging movement in the warp feed direction F to bring the salient end portions 283 into inter-engagement with the re-entrant portions 263 at the new transfer position.

The provision of inter-engaging salient and re-entrant end portions of the guide elements at the transfer position enables the guide elements to resist higher side loading by yarns being traversed from one member to the other without giving rise to misalignment and the consequent abrasion and snagging of the traversing yarns. As a consequence of the resistance to higher side loads the thickness of the guide elements 26 and 28 can be substantially reduced without giving rise to misalignment.

Figure 4C:
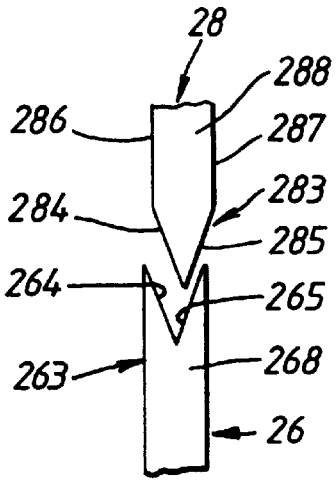
FIG. 4C is a further schematic scrap view showing salient and re-entrant end portions of two cooperating guide elements in misalignment in the weft direction.

Furthermore, a small amount of misalignment as illustrated in FIG. 4C prior to inter-engagement of the salient and re-entrant portions 283 and 263 of the guide elements 28, 26 can be tolerated as this is corrected by self-alignment during the predetermined engaging movement of the yarn guide member 21. A small amount of flexing of the inter-engaging guide elements 26 and 28 can also be tolerated without losing their alignment with each other.

It will be apparent that a substantial reduction in yarn abrasion and snagging can also be achieved by arranging for the salient and re-entrant end portions 283 and 263 of the guide elements 28 and 26 to be inclined to the warp feed direction F so that the transfer of yarns to be carried out can be made to a shed angle which is not coincident with the angle of inclination of the salient and re-entrant end portions 283 and 263.

There still however remains the possibility of yarn abrasion and snagging at the exposed junctions 290 and 291 along the side faces 286 and 287 of the registering guide elements 26 and 28 particularly at the end of the junction where the yarns are fed to the openings between adjacent guide elements at an angle inclined to the side faces 286 and 287.

Figure 5B:
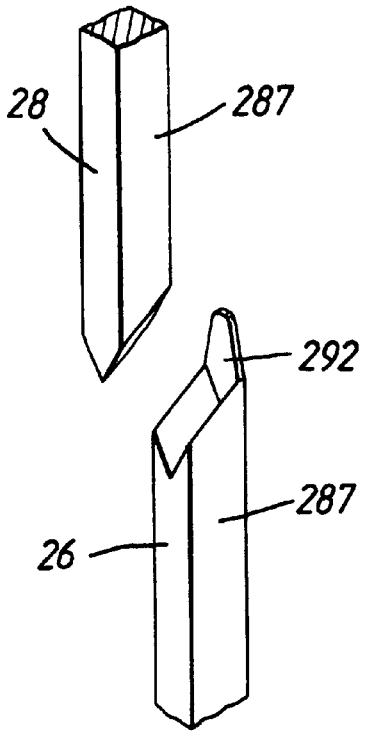
FIG. 5B is a schematic isometric scrap view showing the salient and re-entrant end portions of two cooperating guide elements of the yarn transfer mechanism shown in FIG. 5A and the disposition of the yarn diverter blade illustrated in FIG. 5A.
Figure 5C:
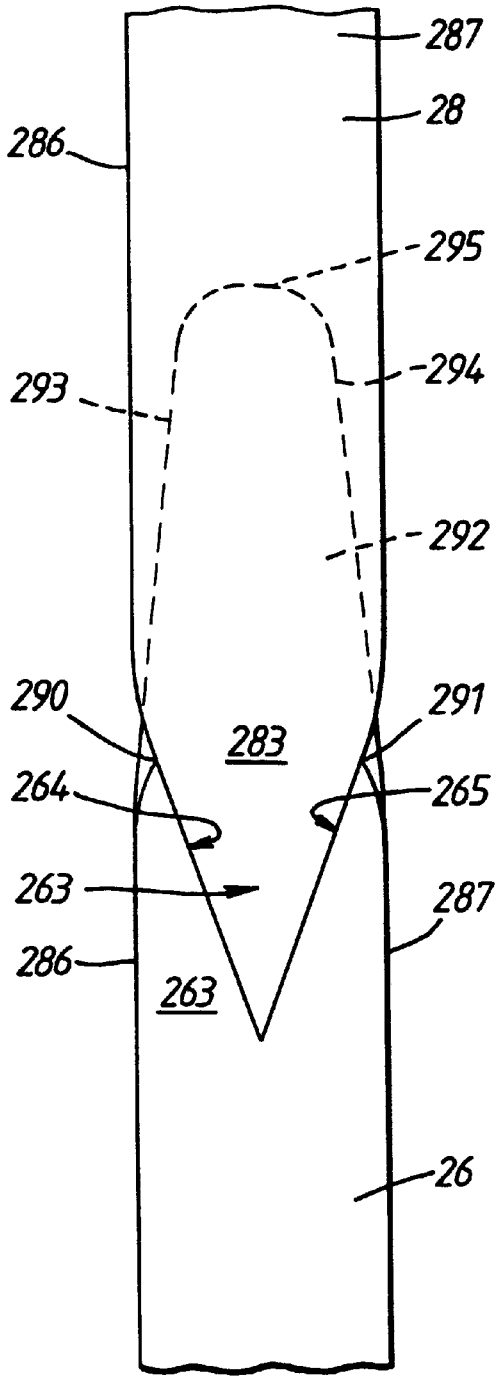
FIG. 5C is a schematic scrap view showing in detail the engaging salient and re-entrant end portions of two engaging guide elements shown in FIG. 5A and the form which the cooperating yarn diverter blade takes.

To further reduce the risk of abrasion and snagging of the yarns during transfer of yarns from one member to the other, the ends of the guide elements are further modified as shown in FIGS. 5A, 5B and 5C in accordance with a second aspect of the invention.

Referring first to FIG. 5A, the yarn guide member 21 and the yarn transfer member 22 are shown with their guide elements 26 and 28 in inter-engagement with each other but the members 21 and 22 are viewed in the opposite direction to that in FIG. 4A so that the rear faces 289 of the guide elements 26 and 28 are open to view. As will be seen, the rear faces 289 of the guide elements 26 of the yarn guide member 21 are extended to provide yarn diverter blades 292 which extend from the end portion of each guide element 26 in a direction away from the support portion 211.

The yarn diverter blade 292 on each guide element 26 is shown also in FIG. 5B. FIG. 5C shows more clearly its profile and the locations of the exposed side junctions 290 and 291.

As will be seen from FIG. 5C the yarn diverter blade 292 has converging side walls 293 and 294 which terminate in an end wall 295. The side walls 293 and 294 extend from the side faces 286 and 187 in such a way as to form a diverter blade which has a maximum width no greater than the maximum width of the guide element 26 between the two faces 286 and 287.

In addition, the salient end portion 283 of the guide element 28 and the re-entrant portion 263 of the guide element 26 are so constructed as to form exposed side junctions 290 and 291 which lie at locations inside the boundaries of the side faces 286 and 287 and within the boundary of the diverter blade 292 at the location of the two junctions.

Clearly the yarn diverter blades 292 serve to shield the incoming warp yarns from the exposed side junctions 290 and 291 particularly in the region of the rear faces 289 which receive inclined incoming warp yarns from the warp yarn supply.

While the modifications to the yarn guide and transfer members 26 and 28 as described with reference to FIGS. 4A, 4B and 4C and FIGS. 5A, 5B and 5C deal with the problem of yarn abrasion and snagging, there is the further problem when constructing a multi-axial yarn structure forming machine on the lines of FIG. 2A of providing sufficient space between the guide member 21 and the oppositely inclined bias yarns 11 and 12 for insertion of the insertion needle 24 carrying the binding warp yarns 13 and a modification of the machine of FIG. 2A to overcome this problem and in accordance with the third aspect of the invention will now be described initially with reference to FIG. 6A.

Referring now to FIG. 6A it will first be seen that the modified part of the machine is shown with the warp feed direction F opposite to that of the machine shown in FIG. 2A as a consequence of which the multi-axial yarn structure 10 is formed at the left of the figure and not to the right as shown in FIG. 2A.

It will furthermore be seen that the yarn transfer mechanism 18 of FIG. 2A has been replaced by two yarn transfer mechanisms 18A and 18B, each of which has a yarn guide member 21 and a yarn transfer member 22 which take the form of the modified yarn guide member 21 and the modified yarn transfer member 22 described with reference to FIG. 5A, FIG. 5B and FIG. 5C.

The spacing between the two yarn transfer mechanisms 18A and 18B is schematically illustrated in FIG. 6C which is a schematic section through the guide elements 26 and which shows warp yarns 171 of the warp sheet 17 passing through the openings between adjacent guide elements 26 to provide a binding warp yarn insertion zone 301 bounded by the warp yarns 171.

The zones 301 provide for insertion of binding warp yarns under the action of binding warp yarn insertion needles which are, as shown in FIG. 6A, arranged as an upper needle assembly 310 comprising upper needles 311 and 312 and a lower needle assembly 313 comprising lower needles 314 and 315. The dispositions of the needle assemblies 310, 313 are shown in FIG. 6B which is a schematic cross-section taken through the yarn transfer members 28 and the upper needle assembly 310. In the disposition of the yarn guide and yarn transfer members 21 and 22 shown in FIG. 6A the yarn guide elements 26 lie beneath the guide elements 28 and do not therefore appear in FIG. 6B.

Clearly, the zones 301 are fully adequate to receive the upper and lower needle assemblies 310 and 313 in contrast to the arrangement of FIG. 2A in which the needle 24 is required to operate within a confined zone as illustrated in the schematic cross-section shown in FIG. 6D where the zone is confined to the region 302. The provision of a spacious binding warp yarn insertion zone 301 allows for the use of a twin needle assembly and also the use of both upper and lower insertion needle assemblies, thereby enabling more complex forms of multi-axial yarn structure to be produced.

Returning to FIG. 6A, it will be seen that the binding warp yarns 13 inserted by the upper and lower needle assemblies 310, 313 are supplied to the needles through openings 303 and 304 in the guide elements 28 and 26 of the guide and transfer members 21 and 22 of the transfer mechanism 18A.

In bringing the yarn transfer members 22 from the transfer position shown in FIG. 6A to a new transfer position in which the yarn transfer member 22 is displaced in the weft direction, it is necessary to provide for either the transfer member 22 or the guide member 21 first to carry out a predetermined disengaging movement in which the one or the other is moved in the warp feed direction or in the opposite direction by an amount sufficient to bring the salient end portions of the guide elements 28 clear of the re-entrant end portions of the guide elements 26.

In the arrangement now to be described with reference to FIGS. 7 to 12 transfer of the yarn transfer members 22 from one transfer position to another is described in which the yarn guide members 21 are displaced to bring them clear of the yarn transfer members 22 as illustrated in FIGS. 7 and 8.

Figure 9:
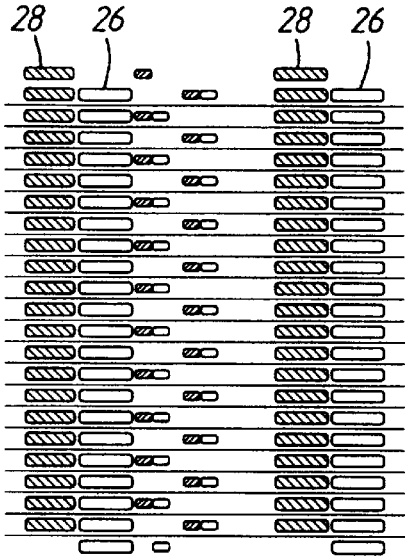
Figure 10:
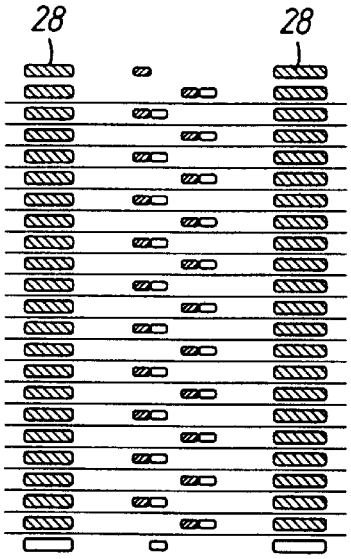
Figure 11:
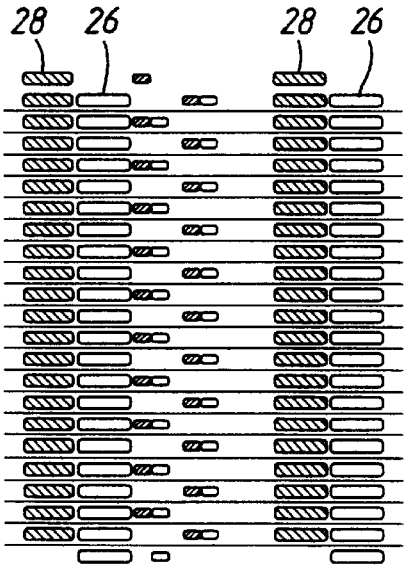
Figure 12:
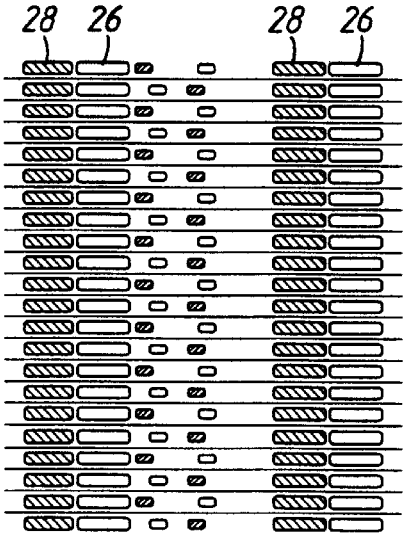

From the position illustrated in FIGS. 7 and 8 the yarn transfer members 22 are moved in the weft direction to take up the disposition shown in FIG. 9 and as will be seen it is arranged that the upper needles 311 and 312 of the upper needle assembly 310 move with the yarn transfer members 22. Re-engagement of the yarn guide and yarn transfer members 21 and 22 is then carried out as illustrated in FIG. 10 to transfer selected warp yarns. A further disengagement of the yarn guide members 21 then takes place as shown in FIG. 11 followed by a return transfer movement to the position shown in FIG. 12 and a further re-engagement of the members 21 and 22 to bring the yarn transfer guide members 21 and 22 back to their original dispositions as shown in FIG. 6B.

It will be apparent that although two transfer mechanisms 18A and 18B are being utilised in the machine described with reference to FIG. 6A with modified forms of the yarn guide and transfer members 21 and 22, they effectively carry out the successive transfer steps which serve progressively to move the warp yarns of the warp sheet 17 into diagonal ±45° non-woven warp yarn sub-assemblies in the same manner as the mechanism 18 illustrated in FIG. 2A and that a succession of processing steps follows each transfer step.

More particularly, following a bias yarn transfer step a binding warp yarn insertion step is carried out, for example, by the upper binding warp yarn needle assembly 310 in which binding warp yarns 13 are passed through the bias yarn structure behind the bias yarns by the insertion needles 311, 312 followed by a weft insertion step in which a lower weft yarn (not shown) is inserted behind the binding warp yarn 13. This is followed by a beating up step to bring the bias yarns and the newly inserted lower weft yarn to the fell point of the yarn structure being formed. The beater is then retracted and the upper needle assembly 310 is then returned to its retracted position following which a further weft yarn insertion step is carried out by insertion of an upper weft yarn (not shown) behind the return run of the binding warp yarn and is followed by a further beating up step.

This procedure can also be followed by the lower binding warp yarn needle assembly 313 or both needle assemblies 310 and 313 can be operated to insert binding warp yarns 13 to predetermined depths in the structure where yarn structures of more complex form are required.

It will be appreciated that the multi-axial yarn structure forming machine illustrated in and described with reference to FIG. 6A makes use of the first, second and third aspects of the invention, insofar that (i) the guide elements 26 and 28 are formed with inter-engaging salient and re-entrant end portions, (ii) the guide elements 26 are formed with yarn diverter blades 292 and (iii) the yarn transfer is carried out utilising two yarn transfer mechanisms 18A and 18B.

It will however be appreciated that these three different aspects of the invention can be utilised individually by appropriate modifications to the multi-axial yarn structure forming machine described with reference to FIG. 2A and need not be used in combination although there are advantages in combining them.

Furthermore, a beater assembly according to the fourth aspect of the invention and now to be described can be used not only as part of the machine described with reference to FIG. 6A but also as a modification of the machine illustrated in FIG. 2A.

In the embodiment of the invention according to its fourth aspect and as now to be described with reference to FIGS. 13A to 13D, a yarn beater member 305 is arranged to cooperate with a yarn engagement transfer member 306 in such a manner as to allow during a transfer displacement for withdrawal of the beat up member 305 at the beat up location and for its replacement by the yarn engagement transfer member 306 which holds and supports the yarns at the beat up location during a return displacement of the beat up member and its next beat up displacement.

The beat up member 305 and the yarn engagement transfer member 306 take the same form as the yarn guide and yarn transfer members 21 and 22, that is to say, they have guide elements 26 and 28 provided with inter-engaging salient and re-entrant end portions as described with reference to FIGS. 4A, 4B and 4C and yarn diverter blades as described with reference to FIGS. 5A, 5B and 5C and are brought to inter-engaging dispositions at the beat up location to facilitate the withdrawal of the yarn beat up member 305 and the insertion of the yarn engagement transfer member 306 at the beat up location.

A beater drive unit (not shown) is arranged to cause a predetermined beat up displacement of the yarn beat up member 305 and a yarn transfer displacement of the inter-engaging yarn beat up member 305 and the yarn engagement transfer member 306 in each beat up cycle in a succession of steps which can be followed by reference to FIGS. 13A, 13B and 13C.

Commencement of the beat up cycle is taken to be that in which the two members are in the positions shown in full line in FIG. 13A where the yarn beat up member 305 is in a retracted position (I) at the beat up location and the yarn engagement transfer member 306 is at the yarn engagement position (II) at the beat up location. A beat up cycle then follows in which the yarn beat up member 305 is caused first to carry out a beater return displacement in which it moves from its retracted position (I) at the beat up location to a retracted position (III) at a beater insertion location and then to move through a beater engagement displacement in which it moves from its retracted position (III) to a yarn engagement position (IV) at which yarns 11 and 12 take up positions in the openings between guide elements 26 of the beat up member 305.

The yarn beat up member 305 is then caused to commence a beat up displacement in which it moves from the yarn engagement position (IV) at the beater insertion location to an intermediate position (V) also shown in FIG. 13B at which time the yarn engagement transfer member 306 is caused to carry out a withdrawal displacement in which it moves from its yarn engagement position (II) at the beat up location to a retracted position (VI) at the beat up location. The yarn beat up member 305 then continues its beat up displacement to take up as shown in FIG. 13C a registering disposition (VII) at the beat up location in which the ends of the guide elements 26 of the yarn beat up member 305 register and inter-engage with the ends of the guide elements of the yarn engagement transfer member 306 at its retracted position (VI).

The yarn beat up and yarn engagement transfer members 305 and 306 are then caused to carry out while in their inter-engaging dispositions (VII) and (VI) a transfer displacement in which the yarn beat up member 305 moves from the yarn engagement position (VII) to the retracted position (I) and the yarn engagement transfer member 306 moves from its retracted position (VI) to the yarn engagement position (II).

In the beat up assembly described with reference to FIGS. 13A, 13B and 13C it is arranged that the yarn beat up member 305 extends to the full width of the multi-axial yarn structure being formed so that the bias yarns of the bias yarn sub-assemblies produced by the yarn transfer mechanisms 18A and 18B are held stable across the full width of the structure by the guide elements 28 of the yarn engagement transfer member 306 which remains in place at the beat up location at the fell of the structure to stabilise the yarns across the full width of the structure until the next beat up displacement of the yarn beat up member 305 is almost complete. In addition, by arranging for the yarn beat up and yarn engagement transfer members 305 and 306 to be constructed in accordance with the first and second aspects of the invention their transfer displacement in their inter-engaging dispositions (VI) and (VII) through the yarn structure is carried out without giving rise to yarn abrasion or snagging at the junctions of the two members where the relative displacement is one in which the junctions are caused to pass through the yarns at the beat up location as opposed to the movement of the yarns past the junctions in the yarn transfer mechanisms 18A ad 18B.

A further advantage of the beat up assembly according to the fourth aspect of the invention is that the bias yarns are stabilised across the full width of the structure and make it unnecessary to employ a pin block mechanism as described in WO96/24713.

It will be appreciated that there is a temporary slackening of the yarn at the beat up location when the yarn engagement transfer member 306 is withdrawn to allow the yarn beat up member 305 to move to the beat up location, but this is considered to be acceptable in most circumstances. If however, for example, in the generation of a very thick wide yarn structure the outer bias yarns remain unstable even when using the yarn beat up member 305 and the yarn engagement transfer member 306 extending to the full width of the structure being formed, alternative means may be provided for supporting the outermost bias yarn loops and arranging for the yarn engagement transfer member 306 to provide general stability for the structure being formed.

In one alternative arrangement, two outer support pins can be provided which are replaced each time bias yarns are beat up and which move with the structure being formed over a short distance. This could be achieved through the use of a pin block mechanism as described in WO96/24713.

If outer travelling pins are employed it may need to be arranged that they are of relatively small cross-section to facilitate movement of the structure although all of the other important dimensions of the beat up assembly may remain unchanged.

The use of a beat up assembly according to the fourth aspect of the invention and as hereinbefore described with reference to FIGS. 13A to 13D has the additional advantage that the machine can be started, stopped or parked when required which allows several transfers by the yarn transfer mechanisms 18A and 18B to be carried out without a beat up cycle occurring. This reduces wear and damage to yarns which will arise from redundant beat up cycles.

What is claimed is:

1. A machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

a yarn guide member having a support portion extending in the weft direction and a plurality of guide elements which extend laterally from the support portion to form a row of equi-spaced guide elements which terminate in ends lying on a line extending in the weft direction and which define between pairs of adjacent guide elements warp yarn guide openings through which warp yarns of the warp sheet are caused to pass and by which the warp yarns are confined to predetermined relative positions therein along the weft direction a yarn transfer member having a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which warp yarns of the warp sheet are transferred and by which the warp yarns are confined to predetermined relative positions therein along the weft direction, yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements of the yarn guide member and in which transfer openings in the yarn transfer member register with yarn guide openings in the yarn guide member and shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings characterised in that:

each guide element of one of the members has an end portion which includes or is formed as a salient end portion, each guide element of the other of the members has an end portion which includes or is formed as a re-entrant end portion, the salient and re-entrant end portions of the guide elements are complementary and such as to engage each other at each of the transfer positions and to bring registering guide elements into inter-engaging alignment in the weft direction upon a predetermined engaging movement of the yarn transfer member, and the yarn transfer drive means is such as to cause the yarn transfer member to carry out the predetermined engaging movement upon advancement of the yarn transfer member to the transfer position and to cause the transfer member to carry out a predetermined disengaging movement upon withdrawal of the yarn transfer member from the transfer position.

2. A machine according to claim 1, wherein:

each guide element is of rectangular or square cross-section with side faces which define the transfer and guide openings and which extend from the support portion and front and rear faces which extend from the support portion, the salient end portion of each guide element has converging end face portions which extend from the side faces of the guide element and which converge in a direction away from the support portion, and the re-entrant end portion of each guide element has diverging end face portions which extend toward the side faces of the guide element and which diverge in a direction away from the support portion.

3. A machine according to claim 2, wherein the salient end portion of each guide element extends across the guide element from the front face to the rear face of the element in a direction parallel to the side faces of the guide element and at an angle inclined to the warp feed direction and in each of the transfer positions opposes a complementary inclined re-entrant end portion of a registering guide element.

4. A machine according to claim 3, wherein the shedding means is such as to shed the selected warp yarns to form a shed, the shed angle of which is not coincident with the angle of inclination of the salient and re-entrant end portions to the warp feed direction.

5. A machine according to claim 2, wherein the lines of intersection of the end face portions of the salient and re-entrant end portions with the associated side faces of the guide element are parallel to each other and to their line of intersection with each other.

6. A machine according to claim 1, wherein the end face portions of the salient and re-entrant end portions form the entirety of the end faces of the guide elements.

7. A machine according to claim 1, wherein the end face portions of the salient and re-entrant end portions form part only of the end faces of the guide elements which include further end face portions.

8. A machine according to claim 1, wherein the converging end face portions of the salient end portion of each guide element are equally inclined to the associated side faces of the guide element.

9. A machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

a yarn guide member having a support portion extending in the weft direction and a plurality of guide elements which extend laterally from the support portion to form a row of equi-spaced guide elements which terminate in ends lying on a line extending in the weft direction and which define between pairs of adjacent guide elements warp yarn guide openings through which warp yarns of the warp sheet are caused to pass and by which the warp yarns are confined to predetermined relative positions therein along the weft direction a yarn transfer member having a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which warp yarns of the warp sheet are transferred and by which the warp yarns are confined to predetermined relative positions therein along the weft direction, yarn transfer drive means to cause predetermined relative displacements of the yarn transfer member and the yarn guide member in the weft direction to bring the yarn transfer member to any one of a plurality of transfer positions in which ends of the guide elements of the yarn transfer member oppose and register with ends of the guide elements of the yarn guide member and in which transfer openings in the yarn transfer member register with yarn guide openings in the yarn guide member and shedding means on the supply side of the transfer mechanism for shedding selected warp yarns to cause the selected yarns to move from predetermined first yarn guide openings in the yarn guide member to registering yarn transfer openings in the yarn transfer member and following displacement of the yarn transfer member to another of the plurality of the transfer positions to return the selected warp yarns to the warp sheet and into predetermined second yarn guide openings in the yarn guide member offset from the predetermined first yarn guide openings wherein:

each guide element is of rectangular or square cross-section with side faces which define the transfer or guide openings and which extend from the support portion and front and rear faces which extend from the support portion, and each guide element of each of the members has an end portion with an end face whereby the end faces of the end portions of registering guide elements are brought into engagement with or in close proximity to each other at each of the transfer positions and define exposed side junctions at the side faces of the registering guide elements to be traversed by yarns traversed between the yarn guide and yarn transfer openings characterised in that:

a yarn diverter blade is provided which extends from the end portion of each guide element of one of the members at the rear face of the guide element and in a direction away from the support portion of the member to hold the yarns away from the exposed side junctions as the yarns are traversed between the yarn guide and yarn transfer openings.

10. A machine according to claim 9, wherein:

the yarn diverter blade extends to a maximum width no greater than the maximum width of the guide element between the two side faces, and the end portion of each guide element of each of the members is so constructed as to form at each of the transfer positions exposed side junctions between registering guide elements which lie at locations inside the boundaries of the side faces of the registering guide elements.

11. A machine according to claim 10, wherein each guide element of one of the members has an end portion which includes or is formed as a salient end portion, each guide element of the other of the members has an end portion which includes or is formed as a re-entrant end portion, the salient and re-entrant end portions of the guide elements are complementary and such as to engage each other at each of the transfer positions and to bring registering guide elements into inter-engaging alignment in the weft direction upon a predetermined engaging movement of the yarn transfer member, and the yarn transfer drive means is such as to cause the yarn transfer member to carry out the predetermined engaging movement upon advancement of the yarn transfer member to the transfer position and to cause the transfer member to carry out a predetermined disengaging movement upon withdrawal of the yarn transfer member from the transfer position, each guide element is of rectangular or square cross-section with side faces which define the transfer and guide openings and which extend from the support portion and front and rear faces which extend from the support portion, and the salient end portion of each guide element extends across the guide element from a front face to a rear face of the element in a direction parallel to the side faces of the guide element at an angle inclined to the warp feed direction and in each of the transfer positions opposes a complementary included re-entrant end portion of a registering guide element.

12. A machine according to claim 11, wherein the shedding means is such as to shed the selected warp yarns to form a shed, the shed angle of which is not coincident with the angle of inclination of the salient and re-entrant end portions to the warp feed direction.

13. A machine according to claim 11, wherein the lines of intersection of the end face portions of the salient and re-entrant end portions with the associated side faces of the guide element are parallel to each other and to their line of intersection with each other.

14. A machine according to claim 9, wherein the end face portions of the salient and re-entrant end portions form the entirety of the end faces of the guide elements.

15. A machine according to claim 9, wherein the end face portions of the salient and re-entrant end portions form part only of the end faces of the guide elements which include further end face portions.

16. A machine according to claim 11, wherein the converging end face portions of the salient end portion of each guide element are equally inclined to the associated side faces of the guide element.

17. A machine for forming a multi-axial yarn structure comprising warp yarn supply means for supplying in a warp feed direction warp yarns in the form of a warp sheet, and bias yarn assembly forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn assembly forming means comprising:

yarn guide means defining yarn guide openings through which the warp yarns of the warp sheet are caused to pass and which hold the warp yarns in predetermined relative positions along the weft direction, and yarn transfer means defining yarn transfer openings and being located at a predetermined initial yarn receiving position with respect to the yarn guide means, shedding means between the warp yarn supply means and the yarn guide means for shedding selected warp yarns to transfer the selected yarns from predetermined openings in the yarn guide means to yarn transfer openings in the yarn transfer means at the initial yarn receiving position, yarn transfer drive means to cause relative displacement of the yarn transfer means and the yarn guide means in the weft direction to bring the yarn transfer means to an offset position offset from the yarn receiving position and thereby to bring the selected-warp yarns upon their return to the warp sheet into openings in the yarn guide means offset from the predetermined openings in the yarn guide means and drive control means to drive the shedding means and the yarn transfer drive means successively to transfer each yarn from the opening it occupies in the yarn guide means to another opening in the yarn guide means to produce the non-woven bias yarn assembly, characterised in that:

(i) the yarn guide means comprises first and second yarn guide members each having yarn guide openings through which warp yarns of the warp sheet are caused to pass and by which the warp yarns are confined to predetermined relative positions therein along the weft direction, (ii) the yarn transfer means comprises first and second yarn transfer members each having yarn transfer openings to which warp yarns of the warp sheet are transferred from the first yarn guide member and by which the warp yarns are confined to predetermined relative positions therein along the weft direction, (iii) the second yarn guide member is of the same form as the first guide member and is so disposed that the warp yarns of the warp sheet pass through openings in the second guide member prior to passage through corresponding yarn guide openings of the first yarn guide member, (iv) the second yarn transfer member is of the same form as the first yarn transfer member and is so disposed that the warp yarns of the warp sheet are transferred from the second yarn guide member to openings in the second yarn transfer member in the same manner as the transfer of the warp yarns from the first guide member to the first transfer member, and (v) the disposition of the second yarn guide member and the second yarn transfer member in relation to the first yarn guide member and the first yarn transfer member is such as to provide a binding warp yarn insertion zone between the first yarn guide and transfer members and the second yarn guide and transfer members, and (vi) binding warp yarn insertion means is arranged to insert at the insertion zone binding warp yarns into the warp yarn assembly in the zone.

18. A machine according to claim 17, wherein (i) the first and second yarn guide members each have a support portion extending in the weft direction and a plurality of guide elements which extend laterally from the support portion to form a row of equi-spaced guide elements which terminate in ends lying on a line extending in the weft direction and which define between pairs of adjacent guide elements the yarn guide openings, (ii) the first and second yarn transfer members each have a support portion extending in the weft direction and a plurality of guide elements which extend laterally from the support portion to form a row of equi-spaced guide elements which terminate in ends lying on a line extending in the weft direction and which define between pairs of adjacent guide elements the yarn transfer openings.

19. A machine for forming a multi-axial yarn structure comprising:

supply means for supplying in a warp feed direction warp yarns in the form of a warp sheet, a bias yarn assembly forming device for forming in a succession of bias yarn forming steps in which warp yarns of the warp sheet are displaced in opposite weft directions a non-woven bias yarn assembly comprising two or more superposed non-woven bias yarn sub-assemblies in which the bias yarns of one sub-assembly are inclined to the bias yarns of the other sub-assembly and in each of which the bias yarns are inclined to the feed direction, binding warp yarn insertion means for passing in each of a succession of binding warp yarn inserting steps binding warp yarns into the non-woven warp yarn assembly, weft insertion means for passing in the weft direction in each of a succession of weft insertion steps a holding weft yarn to hold the binding warp yarns captive in the yarn structure and beater means for beating up the yarns of the superposed sub-assemblies, the binding warp yarns and the holding weft yarns to produce a three dimensional yarn structure, in which the yarns of the superposed sub-assemblies are held in place in the structure by the binding warp yarns which are held by the holding weft yarns, wherein:

the beater means comprises a yarn beat up member having a support portion extending in the weft direction and a plurality of guide elements which extend laterally from the support portion to form a row of equi-spaced guide elements which terminate in ends lying on a line extending in the weft direction and which define between pairs of adjacent guide elements guide openings in which yarns are received during predetermined beat up displacements of the yarn beat up member and in which the yarns are confined to predetermined relative positions therein along the weft direction, and beater drive means to cause in predetermined beat up cycles the predetermined beat up displacement of the yarn beat up member to bring the guide elements of the yarn beat up member to a beat up location at the fell of the yarn structure being formed and the yarns of the non-woven bias yarn sub-assemblies, the binding warp yarns and the weft yarns to the fell of the yarn structure characterised in that:

the beater means further comprises a yarn engagement transfer member which is located at the beat up location and which comprises a support portion extending in the weft direction and a plurality of guide elements which extend laterally from the support portion to form a row of equi-spaced guide elements which terminate in ends lying on a line extending in the weft direction and which define between pairs of adjacent guide elements yarn transfer openings to which yarns from the yarn beat up member, are transferred during a predetermined transfer displacement of the yarn beat up member and the yarn engagement transfer member at the beat up location, and the beater drive means is arranged to cause the predetermined beat up displacement of the yarn beat up member and the predetermined transfer displacement of the yarn beat up member and the yarn engagement transfer member in each of the predetermined beat up cycles in which:

(i) the yarn beat up member is caused to carry out at a beater insertion location a beater engagement displacement in which the guide elements of the yarn beat up member move from a retracted position to a yarn engagement position in which yarns take up positions in the yarn guide openings, (ii) the yarn beat up member is caused to carry out the predetermined beat up displacement in which it moves from the yarn engagement position at the beater insertion location to a yarn engagement position at the beat up location (iii) the yarn engagement transfer member is caused to carry out before completion of the predetermined beat up displacement of the yarn beat up member a withdrawal displacement in which it moves from a yarn engagement position at the beat up location in which it engages yarns at the beat up location and which it occupies at the end of a previous beat up cycle to a retracted position at the beat up location (iv) the yarn beat up member at the yarn engaging position at the beat up location and the yarn engagement transfer member at the retracted position at the beat up location take up a predetermined registering disposition in which the ends of the guide elements of the yarn beat up member oppose and register with the ends of the guide elements of the yarn engagement transfer member, and (v) the yarn beat up member and the yarn engagement transfer member are caused to carry out in their predetermined registering disposition the predetermined transfer displacement in which the yarn beat up member moves from the yarn engagement position to a retracted position and the yarn engagement transfer member moves from its retracted position to the yarn engagement position.

20. A machine according to claim 19, wherein the yarn beat up member is caused to carry out a predetermined beater return displacement in which it moves from its retracted position at the beat up location to its retracted position at the beater insertion location to commence or complete the cycle.

21. A machine according to claim 19, wherein each guide element of one of the members has an end portion which includes or is formed as a salient end portion, each guide element of the other of the members has an end portion which includes or is formed as a re-entrant end portion, and the salient and re-entrant end portions of the guide elements are complementary and such as to engage each other at the predetermined registering disposition and to bring registering guide elements into alignment in the weft direction upon movement of the yarn beat up member to the predetermined registering disposition.

22. A machine according to claim 21, wherein each guide element is of rectangular or square cross-section with side faces which define the guide and transfer openings and which extend from the support portion and front and rear faces which extend from the support portion, the salient end portion of each guide element has converging end face portions which extend from the side faces of the guide element and which converge in a direction away from the support portion, and the re-entrant end portion of each guide element has diverging end face portions which extend toward the side faces of the guide element and which diverge in a direction away from the support portion.

23. A machine according to claim 21, wherein each guide element is of rectangular or square cross-section with side faces which define the transfer or guide openings and which extend from the support portion and front and rear faces which extend from the support portion, each guide element of each of the members has an end portion with an end face whereby the end faces of the end portions of registering guide elements are brought into engagement with or in close proximity to each other at the predetermined registering disposition and define exposed side junctions at the side faces of the registering guide elements traversed by yarns during the predetermined transfer displacements, and a yarn diverter blade is provided which extends from the end portion of each guide element of one of the members at the rear face of the guide element and in a direction away from the support portion of the member to hold the yarns away from the exposed side junctions as the yarns are traversed between the yarn guide and yarn transfer openings of the yarn beat up member and the yarn engagement transfer member.

24. A machine according to claim 23, wherein:

the yarn diverter blade extends to a maximum width no greater than the maximum width of the guide element between the two side faces, and the end portion of each guide element of each of the members is so constructed as to form at the registering disposition exposed side junctions between registering guide elements which lie at locations inside the boundaries of the side faces of the registering guide elements.

* * * * *